US012780376B2

(12) United States Patent
Solbjør

(10) Patent No.: US 12,780,376 B2
(45) Date of Patent: Nov. 3, 2026

(54) MODULAR MOBILE DOCKING STATION FOR SUBSEA VEHICLES

(71) Applicant: Oceaneering International, Inc., Houston, TX (US)

(72) Inventor: Kenneth Solbjør, Sandnes (NO)

(73) Assignee: Oceaneering International, Inc., Houston, TX (US)

( * ) Notice: Subject to any disclaimer, the term of this patent is extended or adjusted under 35 U.S.C. 154(b) by 194 days.

(21) Appl. No.: 18/771,010

(22) Filed: Jul. 12, 2024

(65) Prior Publication Data

US 2025/0019055 A1 Jan. 16, 2025

Related U.S. Application Data

(60) Provisional application No. 63/526,727, filed on Jul. 14, 2023.

(51) Int. Cl.

| | |
|---|---|
| ***B63C 15/00*** | (2006.01) |
| ***B63B 22/00*** | (2006.01) |
| ***B63G 8/00*** | (2006.01) |

(52) U.S. Cl.

CPC ..... *B63C 15/00* (2013.01); *B63B 22/00* (2013.01); *B63G 8/001* (2013.01); *B63G 2008/007* (2013.01); *B63G 2008/008* (2013.01)

(58) Field of Classification Search

CPC ..... B63C 15/00; B63B 22/00; B63G 8/00; B63G 8/001; B63G 2008/007; B63G 2008/008

USPC ..... 114/312

See application file for complete search history.

(56) References Cited

U.S. PATENT DOCUMENTS

| | | | | |
|---|---|---|---|---|
| 6,698,376 | B2 * | 3/2004 | Delahousse | B63B 27/16 114/322 |
| 7,926,438 | B2 * | 4/2011 | Guerrero | B63G 8/001 114/312 |
| 9,718,524 | B2 * | 8/2017 | Gasparoni | B63G 8/001 |

* cited by examiner

*Primary Examiner* — Lars A Olson

(74) *Attorney, Agent, or Firm* — Maze IP Law, P.C.

(57) ABSTRACT

Configurable, modular mobile docking station 1 is configured to accommodate one or more subsea assets selected from different types of subsea assets by changing the configuration of configurable, modular mobile docking station 1 to accommodate each subsea asset based on that subsea asset type. Data communications and power may be provided between the subsea assets and configurable, modular mobile docking station 1 and include data and control communications obtained from a remote control location.

20 Claims, 3 Drawing Sheets

MODULAR MOBILE DOCKING STATION FOR SUBSEA VEHICLES

RELATION TO OTHER APPLICATIONS

This application claims priority through U.S. Provisional Application 63/526,727 filed on Jul. 14, 2023, incorporated herein by reference.

BACKGROUND

The claimed invention relates to resident subsea vehicles, and particularly relates to a mobile docking station which can accommodated different form, type and size of subsea vehicle i.e., remotely operated vehicle (ROV), autonomous underwater vehicle (AUV), hybrid subsea vessel, or the like, as per operational needs.

Currently available mobile docking stations for subsea vehicles are specifically designed to house one specific type of subsea vehicle. However, while working underwater where multiple subsea structures are spread out on the seabed over a large area, multiple or different types of subsea vehicles are required as per the operation, e.g., work or intervention ROVs, survey ROV, Light ROV, AUV, or the like.

FIGURES

Various figures are included herein which illustrate aspects of embodiments of the disclosed inventions.

DESCRIPTION OF EXEMPLARY EMBODIMENTS

Figure 1:
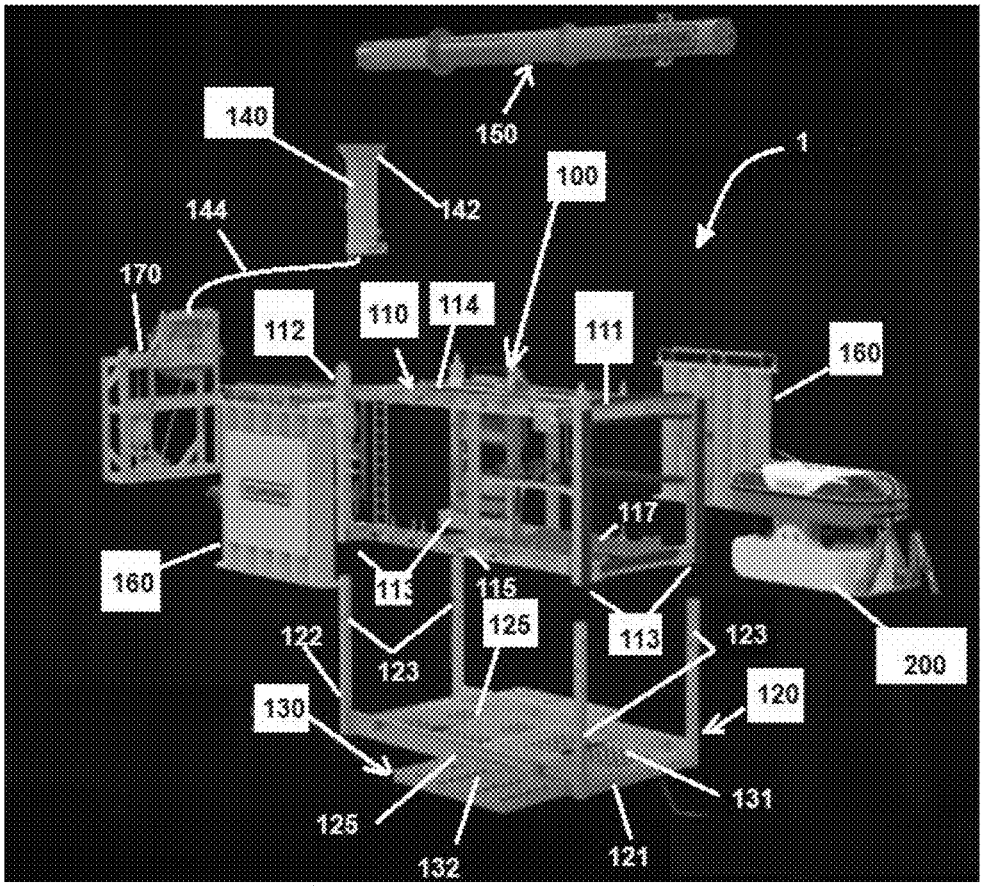
FIG. 1 is a view in partial perspective of an exemplary embodiment of the disclosed invention.

Referring to FIG. 1, in an embodiment configurable, modular mobile docking station 1 is configured to accommodate one or more subsea assets 200 from different types of subsea assets by changing the configuration of configurable, modular mobile docking station 1 and typically comprises modular, reconfigurable main frame 100, dimensioned to provide space to selectively receive and discharge or deploy subsea asset 200; mud mat assembly 130 disposed at a bottom of modular, reconfigurable main frame 100; one or more buoy assemblies 140 operative connected to modular, reconfigurable main frame 100; one or more integrated communications assemblies 150 operatively connected to or otherwise in communication with modular, reconfigurable main frame 100; and electrical energy source 160 operatively in communication with or otherwise comprising a power source such as battery assembly 161, an external power supply, or the like, or a combination thereof.

If subsea asset 200 comprises ROV 202 (FIG. 4), ROV table 117 may be disposed within modular, reconfigurable main frame 100 and dimensioned to allow ROV 202 to skid and fit onto ROV table 117.

Electrical energy source 160 is typically operatively in communication with configurable, modular mobile docking station 1 devices that require electrical energy such as buoy assemblies 140, integrated communications assemblies 150, subsea asset 200, and the like, or a combination thereof, by way of example and not limitation such as by wet-make connectors, wireless connectors, umbilical connections, or the like, or a combination thereof.

In embodiments, modular, reconfigurable main frame 100 comprises substantially rectangular upper box frame 110 and a corresponding substantially rectangular lower box frame 120 comprising the same or similar dimensions with respect to substantially rectangular upper box frame 110 and located at an adjustable vertical distance from substantially rectangular upper box frame 110.

Typically, substantially rectangular upper box frame 110 comprises first end 111, comprising a plurality of leg receivers 113; second end 112 disposed distally from first end 111 where second end 112 comprises a plurality of leg receivers 113; lower frame 115; and upper frame 114 disposed distally from lower frame 115. Upper and lower frames 114,115 are disposed intermediate first and second ends 111,112.

Typically, corresponding substantially rectangular lower box frame 120 comprises lower frame 125 operatively connected to at least one mud mat assembly 130; first end 121 connected to a first edge of lower frame 125; a plurality of legs 123 configured to interface with the plurality of leg receivers 113 of upper box first end 111; and second end 122 connected to a second edge of lower frame 125 disposed distally from first end 121. Second end 122 typically also comprises a plurality of legs 123. It is to be understood that one or more sets of legs 123 and leg receivers 113 may be interchanged, e.g., belong to substantially rectangular upper box frame 110 or substantially rectangular lower box frame 120.

In embodiments, one or more buoy assemblies 140, integrated communications assemblies 150, and electrical energy sources 160 are operatively connected to upper box frame 110.

At least one mud mat assembly 130 typically comprises one or more mud mats 131 configured to rest configurable, modular docking station 1 on a seabed and one or more mud mat extensions 132, typically two, which are extendable to extend from sides of mud mat 131 to increase an area covered by mud mat 131, provide extra support at a seabed to configurable, mobile docking station 1, and limit sink-in of configurable, modular docking station 1 into the seabed.

Figure 2:
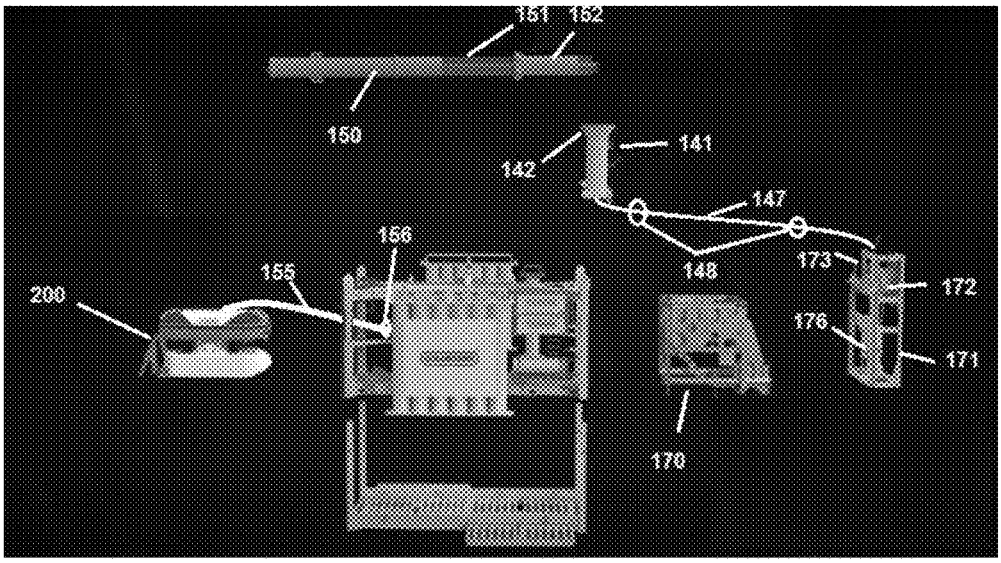
FIG. 2 is an exploded view in partial perspective of an exemplary embodiment of the disclosed invention.

In embodiments, referring additionally to FIG. 2, integrated communications assembly 150 is typically configured to establish data communication with an onshore remote operation center 400 (FIG. 4) and allow onshore remote operation center 400 to issue one or more commands to control operation of configurable, modular docking station 1 and a nearby subsea asset, e.g., vehicle 200. Subsea asset 200 may comprise remotely operated vehicle (ROV) 202 (FIG. 4), autonomous underwater vehicle (AUV) 201 (FIG. 4), a hybrid subsea vehicle, intervention subsea vehicle 203 (FIG. 4), or a combination thereof. However, subsea asset 200 may also comprise a subsea equipment asset other than an underwater vehicle.

Integrated communications assembly 150 typically comprises a data communicator 151 that further comprises data communications buoy 152, an interface to a rig downline, a subsea utility connection, or a combination thereof. Data communications buoy 152 typically allows data connections with an onshore control station such as remote operations center 400 (FIG. 4) to receive control and data signals for performing desired operations such as by means of LTE, Radiolink or Low Earth Orbit Satellite (LEO) networks or through another suitable network medium.

If data communicator 151 comprises data communications buoy 152, buoy assembly 140 may further comprise antenna 141 operatively in communication with data communications buoy 152; guide funnel 142 adapted to selectively receive and deploy data communications buoy 152; buoy umbilical winch 173 operatively connected to main frame 100, and one or more buoy winch umbilicals 144 operatively connected to buoy umbilical winch 173 and to data communicator 151, including to data communications buoy 152. In embodiments, data communications buoy 152 may be incorporated in guide funnel 142.

In addition, buoy umbilical winch 173 may be configured to provide constant tension pay out of umbilical 144. Guide funnel 142 typically includes space for one or more buoyancy floats 148. In these embodiments, when configurable, modular mobile docking station 1 is landed on the seabed, these buoyancy floats 148 may be attached to umbilical 144 to help ensure that umbilical 144 does not lie down on the seabed.

Figure 4:
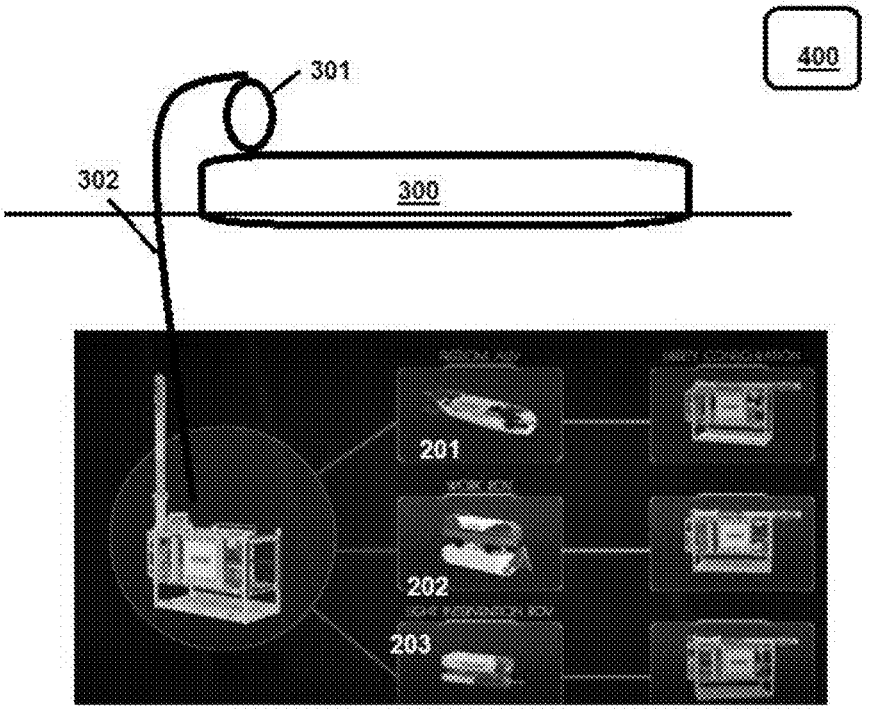
FIG. 4 is a block diagram of an exemplary embodiment of the disclosed invention illustrating various configurations.

In these embodiments, configurable, modular mobile docking station 1 may further comprise one or more sheaves operatively connected to the modular, reconfigurable main frame 100 and one or more electrically driven motors 176 operatively connected to buoy umbilical winch 143 which, in turn, may be operatively in communication with umbilical 155. Buoy umbilical winch 173 and deployment of buoyancy floats 148 and umbilical 144 may be operated and controlled through onshore remote operations center 400 (FIG. 4).

If subsea asset 200 comprises ROV 202,203 (FIG. 4), configurable, modular mobile docking station 1 may further comprise one or more tether management systems (TMS) 170, typically just one, operatively connected to upper box frame 110 (Fig. and to ROV 202,203 and, in embodiments, to electrical energy source 160. configurable, modular mobile docking station 1. In certain embodiments, TMS assembly 170 comprises a cage type electric TMS usable to deploy subsea asset 200 from configurable, modular mobile docking station 1 to a work site. In these embodiments, the cage type electric TMS typically comprises cage 171 defining a housing; one or more tether drums 172 disposed at least partially with cage 171; one or more buoy umbilical winches 173 which may comprise level wind assemblies 173 disposed at least partially with 171 cage and operatively connected to at least one tether drum 172; and electrically driven motor 176 operatively connected to buoy umbilical winch 173. One or more oil compensators 174 (not shown in the figures) and one or more cans 175 (not shown in the figures) may also disposed at least partially with cage 171. If subsea asset 200 comprises AUV 201 (FIG. 4), TMS assembly 170 may not be required and configurable, modular mobile docking station 1 may be configured accordingly.

Figure 3:
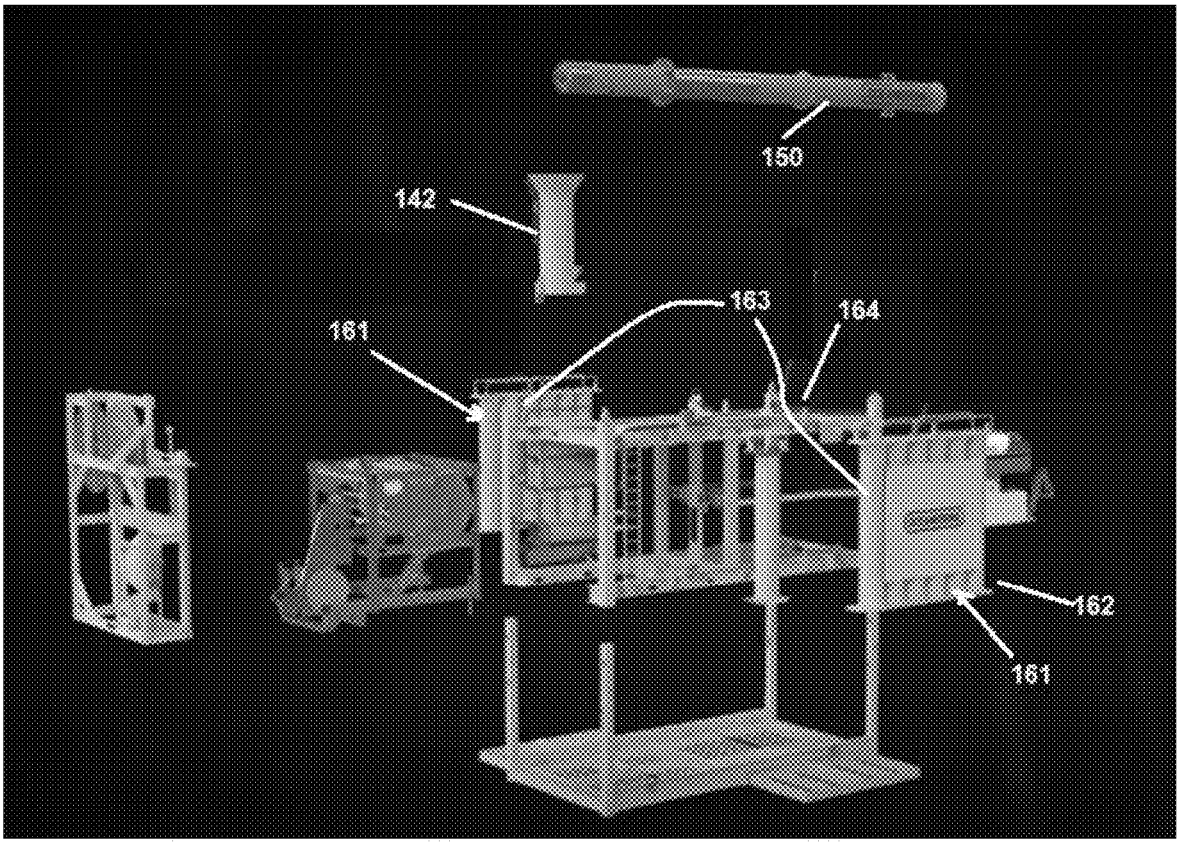
FIG. 3 is a further exploded view in partial perspective of an exemplary embodiment of the disclosed invention.

In embodiments, referring to FIG. 3, electrical energy source 160 typically comprises a battery assembly 161 comprising one or more pressure tolerant battery enclosures 162, e.g., cannisters, and a plurality of batteries 163, which may be disposed at least partially within pressure tolerant battery enclosures 162 and comprise removable batteries which may further comprise rechargeable batteries. Battery enclosures 162 may be selectively removable from and reinstallable on modular, reconfigurable main frame 100 (Fig.

Integrated battery management system (BMS) 164 may also be present, operatively in communication with the plurality of batteries 163, and disposed at least partially within pressure tolerant battery enclosure 162. BMS 164 is typically configured to manage the entire battery system. Where BMS 164 is present, battery system controller (BSC) 165 (not shown in the figures) may also be present, disposed at least partially within pressure tolerant battery enclosure 162, and operatively in communication with BMS 164.

In the operation of exemplary methods, referring to FIG. 4 and FIG. 1, deploying configurable, modular mobile docking station 1, which is as described above, typically comprises using vessel 300 (FIG. 4) which comprises onboard subsea crane 301 (FIG. 4) to deploy configurable, modular mobile docking station 1 using onboard subsea crane 301 via umbilical 302 until configurable, modular mobile docking station 1 is proximate to a seabed, e.g., engages the seabed, at or around which time onboard subsea crane 301 may disengage from configurable, modular mobile docking station 1, leaving configurable, modular mobile docking station 1 on the seabed for a predetermined set of operations, e.g., receiving or discharging subsea asset 200 into or out from configurable, modular mobile docking station 1, allowing control of subsea asset 200 subsea from remote location 400, or the like, or a combination thereof. Vessel 300 may then be deployed to a different location. Configurable, modular mobile docking station 1 may be controlled from onshore remote center 400 (FIG. 4) or autonomously controlled or a combination thereof.

Subsea asset 200 houses inside configurable, modular mobile docking station 1 and, once housed, may be connected with configurable, modular mobile docking station 1 either wirelessly, such as in the case of AUV 201, through a wired tethered connection, such as umbilical 155 in the case of ROV 202,203, or the like. When subsea asset 200 deploys from configurable, modular mobile docking station 1, in the case of subsea vehicles such as AUV 201 or ROV 202,203, subsea vehicles 200 may hover or otherwise linger outside configurable, modular mobile docking station 1 and perform a subsea mission while in communication with configurable, modular mobile docking station 1 and may further be controlled and operated from onshore remote operations station 400 (FIG. 4).

During use and after deployment, a subsea asset type for a different subsea asset 200 located proximate configurable, modular mobile docking station 1 may be determined and configurable, modular mobile docking station 1 reconfigured to accommodate subsea asset 200 based on the determined subsea asset type. This reconfiguration may occur upon retrieval of configurable, modular mobile docking station 1 from its subsea location or subsea. Once reconfigured, subsea asset 200 may be received into the reconfigured configurable, modular mobile docking station 1 and, later, deployed from configurable, modular mobile docking station 1. Configurable, modular mobile docking station 1 is typically configured to accommodate subsea asset 200 based on a determined subsea asset type for subsea asset 200 prior to deployment but may be reconfigured for another subsea asset 200 while deployed. In an embodiment, reconfiguring configurable, modular mobile docking station 1 is done to accommodate subsea asset 200 based on a determined subsea asset type of subsea asset 200 by retrieving configurable, modular mobile docking station 1 to a non-subsea environment, e.g., vessel 300 (FIG. 4), a rig, a platform, or the like, and reconfiguring the retrieved configurable, modular mobile docking station 1 in the non-subsea environment by adjusting a distance between substantially rectangular upper box frame 110 and substantially rectangular lower box frame 120. Once adjusted, reconfigured configurable, modular mobile docking station 1 is redeployed subsea. In this manner, if a subsea project requires the use of ROV 202 in one project, configurable, modular mobile docking station 1 will be configured for ROV 202. If in another project there is a need for AUV 201, configurable, modular mobile docking station 1 is reconfigured for AUV 201. Similarly, another project may require light intervention ROV 203 and configurable, modular mobile docking station 1 can be reconfigured to support light intervention ROV 203.

In other embodiments, configurable, modular mobile docking station 1 is reconfigured subsea to accommodate subsea asset 200 based on the determined subsea asset type.

Figure 5:
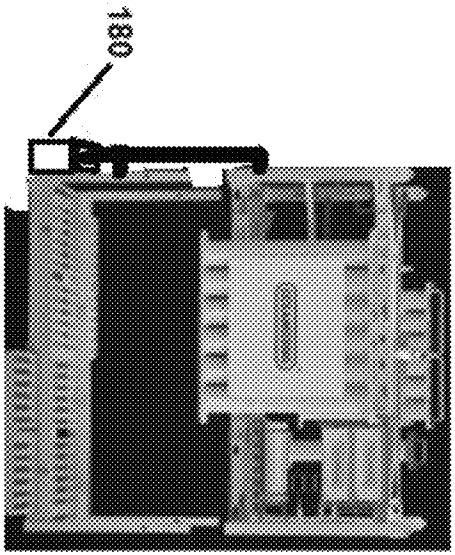
FIG. 5 is a block diagram in partial perspective illustrating an exemplary positioner embodiment of the disclosed invention

Reconfiguration typically involves adjusting a distance between substantially rectangular upper box frame 110 and corresponding substantially rectangular lower box frame as described above. Configurable, modular mobile docking station 1 may further comprise positioner 180 (FIG. 5) operatively connected to the plurality of legs 123, their corresponding leg receivers 113, or both, where positioner 180 is operative to adjust a displacement of the plurality of legs 123 within their corresponding leg receivers 113. Positioner 180 may comprise a jack or other selectively adjustable tool for exerting pressure or lifting and may further be operatively in communication with electrical energy source 160, a hydraulic power source such as via umbilical 302, or the like. In such embodiments, reconfiguring configurable, modular mobile docking station 1 to accommodate subsea asset 200 based on the determined subsea asset type typically comprises adjusting a distance between the substantially rectangular upper box frame 110 and the substantially rectangular lower box frame 120 by using positioner 180.

In embodiments, subsea asset 200 may be operatively connected to electrical energy source 160 and electrical power provided to subsea asset 200 from electrical energy source 160, such as via umbilical 155 and connector 156 if subsea asset 200 is an ROV, wirelessly, or a combination thereof. In addition, electrical energy source 160 may be recharged subsea from vessel 300 via a downline umbilical such as umbilical 302 providing charging power. Where subsea asset 200 comprises AUV 201 (FIG. 4), electrical energy source 160 may comprise an inductive charger and integrated communications assembly 150 or connector 156 may comprise an inductive data communicator to interface with AUV 201.

In addition, subsea asset 200 may be operatively placed into communication with integrated communications assembly 150 and a control command issued to subsea asset 200 via integrated communications assembly 150.

In embodiments, buoy assembly 140 is self-deployable and, as described above, may comprise data communications buoy 152 (FIG. 2), received or otherwise incorporated into guide funnel 142 and operatively connected to umbilical 155. In these embodiments, a predetermined portion of data communications buoy 152 may be stored in guide funnel 142 in a horizontal position proximate a top portion of configurable, modular mobile docking station 1 during transit of configurable, modular mobile docking station 1 to a predetermined location, e.g., by vessel 300. When configurable, modular mobile docking station 1 is launched into water, data communications buoy 152 may be allowed to self-erect and achieve a vertical orientation of guide funnel 142. Guide funnel 142 may be locked into a predetermined vertical orientation, once that vertical orientation is achieved. Once data communications buoy 152 is erect, buoy winch umbilical 144 may be automatically spooled out, such as under constant tension, to position data communications buoy 152 at a predetermined position relative to configurable, modular mobile docking station 1, e.g., oriented vertically, and data communications established between integrated communications assembly 152 and remote operation station 400 (FIG. 4) via data communications buoy 152 to allow controlling subsea asset 200 from the remote operation station. Typically, once communications buoy 152 floats on the sea surface, communications buoy 152 establishes connection with onshore remote operation station 400.

If a subsea operation has completed or if electrical energy source 160 is depleted, configurable, modular mobile docking station 1 may be retrieved to vessel 300, electrical energy source 160 recharged if it needs to be recharged, and configurable, modular mobile docking station 1 redeployed subsea.

The foregoing disclosure and description of the inventions are illustrative and explanatory. Various changes in the size, shape, and materials, as well as in the details of the illustrative construction and/or an illustrative method may be made without departing from the spirit of the invention.

What is claimed is:

1. A configurable, modular mobile docking station configured to accommodate different types of subsea assets, comprising:

a. a modular, reconfigurable main frame dimensioned to provide space to selectively receive and discharge a subsea asset, the modular, reconfigurable main frame comprising:
   i. a substantially rectangular upper box frame;
   ii. a corresponding substantially rectangular lower box frame located at an adjustable vertical distance from the substantially rectangular upper box frame;
   iii. a plurality of legs and corresponding leg receivers disposed between the upper box frame and the lower box frame; and
   iv. a positioner operatively connected to the plurality of legs, the corresponding leg receivers, or both the plurality of legs, the corresponding leg receivers, the positioner operative to adjust a displacement of the plurality of legs within their corresponding leg receivers;

b. a mud mat assembly disposed at a bottom of the modular, reconfigurable main frame;

c. a buoy assembly operative connected to the modular, reconfigurable main frame;

d. an integrated communications assembly operatively connected to the modular, reconfigurable main frame; and e. an electrical energy source operatively in communication with the integrated communications assembly and the buoy assembly.

2. The configurable, modular mobile docking station of claim 1, wherein:

a. the substantially rectangular upper box frame comprises:
   i. a first end comprising a first set of the plurality of leg receivers;
   ii. a second end disposed distally from the first end, the second end comprising a second set of the plurality of leg receivers;
   iii. a lower frame; and
   iv. an upper frame disposed distally from the lower frame, the upper and lower frames disposed intermediate the first and second ends; and b. the corresponding substantially rectangular lower box frame comprises:

i. a lower frame operatively connected to the mud mat assembly;

ii. a first end connected to a first edge of the lower frame and comprising a first set of the plurality of legs configured to interface with the upper box first end first set of the plurality of leg receivers; and iii. a second end connected to a second edge of the lower frame disposed distally from the first end, the second end comprising a second set of the plurality of legs configured to interface with the upper box second end second set of the plurality of leg receivers.

3. The configurable, modular mobile docking station of claim 2, wherein the buoy assembly, the integrated communications assembly, and the electrical energy source are operatively connected to the upper box frame.

4. The configurable, modular mobile docking station of claim 2, wherein the configurable, modular mobile docking station further comprises a tether management system (TMS) operatively connected to the substantially rectangular upper box frame.

5. The configurable, modular mobile docking station of claim 1, wherein the mud mat assembly comprises:

a. a mud mat configured to rest the configurable, modular mobile docking station on a seabed; and b. a mud mat extension extendable from the mud mat.

6. The configurable, modular mobile docking station of claim 1, wherein the integrated communications assembly is configured to establish data communication with an onshore remote operation center and allow the onshore remote operation center to issue a command to control operation of the configurable, modular mobile docking station and the subsea asset.

7. The configurable, modular mobile docking station of claim 6, wherein the integrated communications assembly comprises:

a. a data communicator, the data communicator further comprising a data communications buoy, an interface to a rig downline, subsea utility connection, or a combination thereof; and b. a buoy winch umbilical operatively in communication with the data communicator.

8. The configurable, modular mobile docking station of claim 7, where the data communicator comprises the data communications buoy, wherein:

a. the buoy assembly further comprises:

i. an antenna operatively in communication with the data communications buoy;

ii. a guide funnel adapted to selectively receive and discharge the data communications buoy; and iii. a buoy umbilical winch operatively connected to the modular, reconfigurable main frame and to the umbilical (155); and b. the configurable, modular mobile docking station further comprises:

i. a buoy winch umbilical (144) operatively connected to the buoy umbilical winch and to the data communications buoy; and ii. an electrically driven motor operatively connected to the buoy umbilical winch.

9. The configurable, modular mobile docking station of claim 1, wherein the subsea asset comprises a remotely operated vehicle (ROV), an autonomous underwater vehicle (AUV), a hybrid subsea vehicle, an intervention subsea vehicle, or a combination thereof.

10. The configurable, modular mobile docking station of claim 9, wherein the subsea asset comprises the AUV and the configurable, modular mobile docking station further comprises a tether management system (TMS) assembly operatively connected to the modular, reconfigurable main frame.

11. The configurable, modular mobile docking station of claim 10, wherein the tether management system (TMS) assembly comprises a cage type electric TMS usable to deploy the subsea asset from the configurable, modular mobile docking station to a work site, the cage type electric TMS comprising:

a. a cage defining a housing;

b. a tether drum disposed at least partially with the cage; and c. a level wind assembly disposed at least partially with the cage and operatively connected to the tether drum.

12. The configurable, modular mobile docking station of claim 1, wherein the subsea asset comprises a subsea equipment asset other than an underwater vehicle.

13. The configurable, modular mobile docking station of claim 1, wherein the electrical energy source comprises a battery assembly, the battery assembly comprising;

a. a pressure tolerant battery enclosure; and b. a plurality of batteries.

14. The configurable, modular mobile docking station of claim 13, wherein the battery assembly further comprises an integrated battery management system (BMS) operatively in communication with the plurality of batteries at least partially within the pressure tolerant battery enclosure.

15. The configurable, modular mobile docking station of claim 13, wherein the plurality of batteries further comprise removable batteries, rechargeable batteries, removable rechargeable batteries, or a combination thereof.

16. A method of deploying the configurable, modular mobile docking station of claim 1, the method comprising:

a. configuring the configurable, modular mobile docking station to accommodate the subsea asset based on a determined subsea asset type for the subsea asset;

b. using a vessel comprising an onboard subsea crane to deploy the configurable, modular mobile docking station by using the onboard subsea crane until the configurable, modular mobile docking station is positioned proximate a seabed;

c. disengaging the onboard subsea crane from the configurable, modular mobile docking station; and d. leaving the configurable, modular mobile docking station on a seabed for a predetermined set of operations.

17. The method of claim 16, further comprising controlling the configurable, modular mobile docking station from an onshore remote center, allowing autonomous control of the configurable, modular mobile docking station, or a combination thereof.

18. The method of claim 16, further comprising:

a. determining a subsea asset type for another subsea asset located proximate the configurable, modular mobile docking station;

b. reconfiguring the configurable, modular mobile docking station to accommodate the subsea asset based on the determined subsea asset type; and c. receiving the subsea asset into the reconfigured configurable, modular mobile docking station.

19. The method of claim 16, further comprising:

a. operatively connecting the subsea asset to the electrical energy source; and b. providing power to the subsea asset from the electrical energy source.

20. The method of claim 18, wherein reconfiguring the configurable, modular mobile docking station to accommodate the subsea asset based on the determined subsea asset type comprises:

a. retrieving the configurable, modular mobile docking station to a non-subsea environment;

b. reconfiguring the retrieved configurable, modular mobile docking station in the non-subsea environment by adjusting a distance between the substantially rectangular upper box frame and the substantially rectangular lower box frame; and c. redeploying the reconfigured configurable, modular mobile docking station subsea.

* * * * *